US005139814A

United States Patent [19]

Sugao

[11] Patent Number: 5,139,814

[45] Date of Patent: Aug. 18, 1992

[54] METHOD OF MANUFACTURING METAL PIPES COATED WITH TIN OR TIN BASED ALLOYS

[75] Inventor: Keizo Sugao, Shizuoka, Japan

[73] Assignee: Usui Kokusai Sangyo Kaisha, Japan

[21] Appl. No.: 510,990

[22] Filed: Apr. 19, 1990

Related U.S. Application Data

[63] Continuation of Ser. No. 215,866, Jul. 6, 1988, abandoned.

[30] Foreign Application Priority Data

Jul. 11, 1987 [JP] Japan ..... 62-173668

[51] Int. Cl.[5] ..... B05D 3/02; B05D 7/22

[52] U.S. Cl. ..... 427/46; 427/141; 427/143; 427/189; 427/239; 427/234; 427/398.4

[58] Field of Search ..... 427/46, 239, 234, 181, 427/183, 189, 398.4

[56] References Cited

U.S. PATENT DOCUMENTS

| | | | |
|---|---|---|---|
| 2,803,559 | 8/1957 | Rutherfurd et al. | 427/46 |
| 4,408,561 | 10/1983 | Tokayama et al. | 427/398.4 |
| 4,490,411 | 12/1984 | Feder | 427/46 |
| 4,529,631 | 7/1985 | Neudahm | 427/398.4 |
| 4,551,354 | 11/1985 | Feder | 427/46 |

FOREIGN PATENT DOCUMENTS

| | | | |
|---|---|---|---|
| 1064369 | 4/1986 | Japan | 427/181 |
| 1064370 | 4/1986 | Japan | 427/181 |
| 1064371 | 4/1986 | Japan | 427/181 |
| 1068177 | 4/1986 | Japan | 427/181 |
| 1068179 | 4/1986 | Japan | 427/181 |
| 2063679 | 3/1987 | Japan | 427/181 |

*Primary Examiner*—Janyce Bell

*Attorney, Agent, or Firm*—Anthony J. Casella; Gerald E. Hespos

[57] ABSTRACT

This the method of manufacturing metal pipes by inserting tin or tin based coating material into the metal pipe, raising the temperature rapidly to over 1000° C. in the high frequency furnace in a non-active, or non-oxide atmospheric gas, or in a reducing gas, to coat the entire interior wall of the metal pipe with tin or tin based alloy, and, then, to cool it at a high rate of cooling.

According to this method of manufacturing, a uniform coating is formed in the interior wall of the metal pipe, without giving rise to residuous collection of the coating material, or to the non-formation of coating, and such effects as the prevention of metal corrosion as well as the absence of the weakening of the mechanical strength as vibration resistance and also of pressure resistance may be obtained.

7 Claims, 5 Drawing Sheets

METHOD OF MANUFACTURING METAL PIPES COATED WITH TIN OR TIN BASED ALLOYS

This application is a continuation of U.S. patent application Ser. No. 07/215,866 filed Jul. 6, 1988, now abandoned.

BACKGROUND OF THE INVENTION

1. Field of the Invention

The object of this invention relates to the method of efficiently and reliably uniformly coated metal pipes, particularly those with comparatively small diameter of less than 20 mm, for the use as supply routes for various types of fluid, without giving cause to the occurrence of metal corrosion, or the blockage of the interior of the pipe through the use of corrosion resistant tin and tin based alloy coating, and moreover, even in cases where double walled pipes are employed, without giving cause to the occurrence of segregation of the joint section at the time of processing.

2. Description of Prior Arts

Hitherto, small diameter metal pipes used as car brake oil pipes or as supply routes for other fluids or gaseous fuels were double walled or single walled metal pipes copper plated either on the interior wall only or on both sides. These pipes were, to some extent, corrosion resistant, due to the application of copper plating. However, problems resided, for example, when used as brake oil pipes, the brake oil had the effect of melting out the copper and causing electric corrosion of, for example, the aluminum or aluminum based material of the parts connected to the said brake pipe. There resided, also, the problem of the gasoline being degenerated in the fuel supply pipe.

Because of this, the procedure of coating the interior of the pipe with tin or tin based alloy, which can prevent such harmful effects, has been employed. As one of such means, the method has been proposed of inserting into the metal pipe a metal wire of zinc, tin-zinc, or alloy based on the said substances, with melting point below 450° C., and heating it in a reducing atmosphere gradually to 800°-1100° C. to carburize a part of the zinc substance in the fusible metal wire, and, thus, to form a plated layer by adhering the fusible metal wire to the interior wall of the metal pipe (Japanese Patent Publication No. 18745/1985).

However, by this method, particularly where the double walled pipe, wherein metal strips are brazed with copper, is employed, as can be seen by the X-Ray photograph shown in FIG. 12, due to the strength of the heat far higher than the melting point of the coating material, and the length of the holding time, the molten tin powder flows out to the copper layer at the seam and forms a brittle Su-Cu alloy layer deep into the joint section. Because of this, the problem of the segregation of the inner seam seriously weakening the pressure resistance of the metal pipe at the time of such pipe edge processing, as bulge, flare and spool, and the bending process after the coating treatment was observed that, while reducing atmosphere is used in the heat treatment furnace, generally, the oxygen in the air still remains, to some extent, in the pipe so that, during the process of gradually increasing the temperature of the pipe, it has the effect of forming a hard oxidated layer consecutively in the axial direction of the pipe. Because of this shell-like formed hard oxidated layer, even when heated beyond the melting point of the coating material, the molten coating material remains within the oxidated layer shell and cannot flow out to the interior wall of the pipe. It was also observed that the length of the heating furnace in the axial direction of the pipe was another factor in causing the said effect continuously in the longtitudinal direction. Moreover, by further heating, the said oxidated layer forming a shell, was torn in an instant by the molten substance, by pyrolysis, or by the steam pressure of the fusible wire, and the molten metal around this area flowing inside this shell flows out in a concentrated area. Because this molten metal, having attained a high fluidity due to the activation and low adhesivity caused by heating to a high degree, and also to the metal steam pressure, flows out with force and with consistency, Sn-Fe, Zn-Fe are formed at the interior wall of the metal pipe, near the aperture of the outflow, iron readily melts out, and the base metal is corroded in a concentrated localized are (FIG. 13), causing the phenomenon generally termed metal corrosion. The pipe wall becomes thin and the phenomenon seriously weakening such mechanical strength as the vibration resistance and pressure resistance appears intermittently in the axial direction of the pipe. Also, in extreme cases, there exists the problem of leakage through permeation, and, particularly in the cases employing materials of some length having a minor diameter of less than 4 mm $\phi$, there also exists the problem of blockage of the pipe interior through the concentrated outflow of the said molten metal. Furthermore, deposits occur near the localized are of the outflow (FIG. 11), while in other parts separated from this area, coating is hardly formed at all (FIG. 9), and there existed, in particular, the problem of non-uniform coating formation in the longitudinal direction.

SUMMARY OF THE INVENTION

The object of this invention is to solve the above mentioned problems and to attain a method of manufacturing tin or tin based alloy coating of uniform thickness with facility and accuracy in a short time.

The inventor has, in order to solve the above stated problems and to attain the above stated objective, executed extensive research, and has achieved this invention by manifesting that the object of this invention may be attained through inserting tin or tin based alloys into metal pipes and effecting high frequency heating and the highest rate of cooling. That is, the object of this invention is the method of manufacturing metal pipes coated with tin or tin based alloy into the metal pipe, raising the temperature of the metal pipe rapidly to over 1000° C. in a non-active gas or non-oxide atmospheric gas, or reducing gas, to coat the entire inner wall of the metal pipe, after which, cooling the same at the highest possible rate in the the atmospheric gas.

According to this invention there is provided metal pipes, in general, of carbon steel, and also in general, double walled pipes manufactured from steel strips plated on one side or on both with a 3-5 $\mu$m thickness copper plate, the overlap welded by brazing, or there is provided the same copper plated metal strips formed into an open-seamed pipe, the joint electrically welded. It is desirable, from the point of view of the coating formation of fusible metal, that the pipes be thin pipes of less than 20 mm diameter. It is also desirable that the said pipes be pre-treated by washing with the usual alkaline fluid or with plain water.

According to this invention there is provided as coating material, tin, tin-zinc alloy, tin-lead alloy, zinc-plated tin base, or zinc clad tin. There is provided, also, that the material may be in wire, thin sheet or powdered state, to be selected, respectively, according to the minor diameter of the metal pipe to be employed, as, for example, in the case of a metal pipe of minor diameter 6.5 mm, an 0.5 mm wired material shall be selected.

The heat treatment conducted on the above stated metal pipe, inserted with the above stated coating material, is the rapid heating of the said metal pipe, inserted with the said coating material, to over 1000° C. in a non-active gas or non-oxide atmospheric gas or reducing atmosphere by the use of the high frequency furnace. By setting the furnace to a high frequency of 10–400 KHz, it becomes possible to conduct the heat treatment to the designated temperature in a short time so that, even where the interior of the pipe has not reached the reducing, or other designated, atmospheric state, the coating material is permitted to melt smoothly and consistently through the axial direction of the pipe to form a uniform coating in the pipe without causing any hard oxidated layer on the surface of the coating material.

Moreover, the heat treatment is such that the metal pipe passes through the furnace at a speed of 5–50 m/min.

The metal pipe, coated with tin or tin based alloy by the heat treatment, is immediately undergone a cooling treatment at the highest possible speed within the same atmospheric gas as for the heat treatment, by, for example, cooling nitrogen gas.

Furthermore, by the method of this invention, it is possible, for example, to effect a multiple layer coating through use of, first, a high melting temperature coating material and then, secondly, a low melting temperature (fusible) coating material.

As the method of this invention is to insert tin or tin based coating material into the metal pipe and to melt and spread it smoothly without causing the oxidated layer to form on the surface of the coating material, and to cool it at highest possible speed, excellent results as the formation of uniform coating in the interior of the pipe, without any concentrated residues of the coating material nor residues from the non-formation of coating, may be observed. Moreover, where a double walled pipe is employed, such excellent results may be observed as the reduction of the penetration by diffusion of the coating material to the inner seam, prevention of the segregation of the inner seam at the time of the pipe edge forming and at the bending process, as well as the prevention of metal corrosion, which is the corrosion of the basic material caused by the concentration of the coating material in localized spots, the prevention of the decrease in the mechanical strength such as vibration resistance, and the prevention of the pressure resistance. Moreover, even in cases where narrow pipes of less than 4 mm $\phi$, it was observed that no blockage had occurred.

The following are practical examples of this invention:

EXAMPLE 1

Tin-Zinc wire of diameter 0.44 mm is inserted into the double walled pipe of external diameter 6.35 mm, thickness of 0.7 mm, and length 6 m, made from steel strips and plated on both sides with thickness 3 $\mu$m copper plates. The interior is set as nitrogen gas atmosphere, and the pipe is passed through the high frequency quartz furnace, set at 200 KHz high frequency, at a passing speed of 50 m/min., and heat treated to raise the steel pipe's surface temperature to 1150°–1200° C. The product was, then, completed by the highest possible rate of cooling, by using nitrogen gas cooled to −10° C.

The double walled pipe manufactured by this treatment was cross cut, and the coating layer formed in the pipe and the seam condition were observed by the Secondary Electron Map (SEM), using the scanning electron microscope, and by the X-Ray photograph (dot map).

Figure 1:
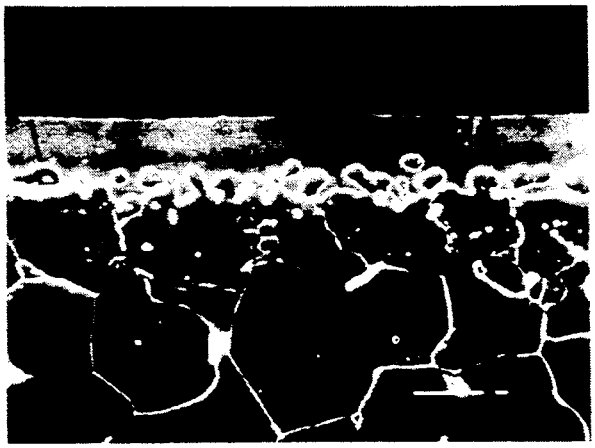
FIG. 1 shows the metal structure map obtained from the observation of the condition of the coating formation, taken from the practical example product of this invention, by the use of the electron microscope, and enlarged to 600 times by the Secondary Electron Map (SEM)
Figure 2:
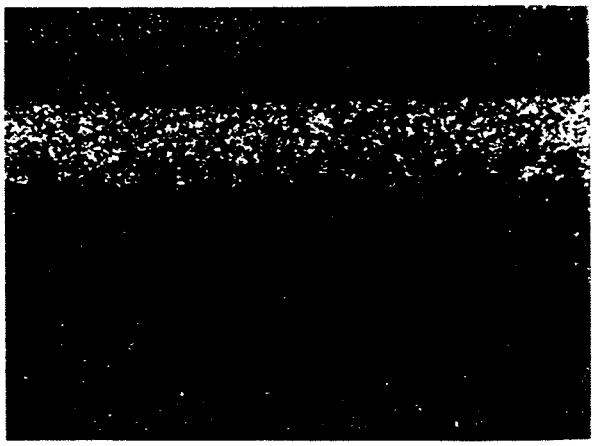
FIG. 2 and FIG. 3 are X-Ray photos (dot map), respectively, of the tin and copper powder condition at the same location as FIG. 1.
Figure 3:
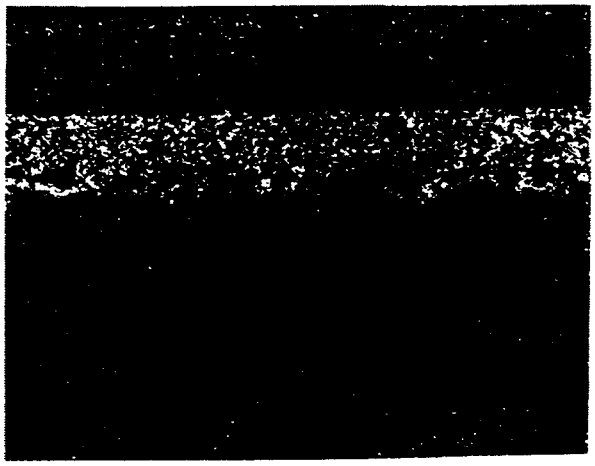

As a result, the 600-times enlarged SEM photograph was as shown in FIG. 1, the dot map of the tin and copper, as shown in FIG. 2 and FIG. 3, and it was found that a tin based coating of uniform thickness of approximately 10 $\mu$m had been formed.

Figure 4:
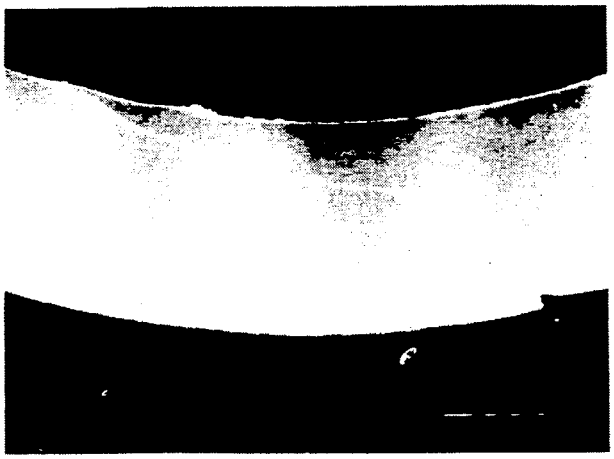
FIG. 4 is a metal structure figure of the seam section of the practical example product of this invention, shown by the 40-times enlarged SEM photograph.
Figure 5:
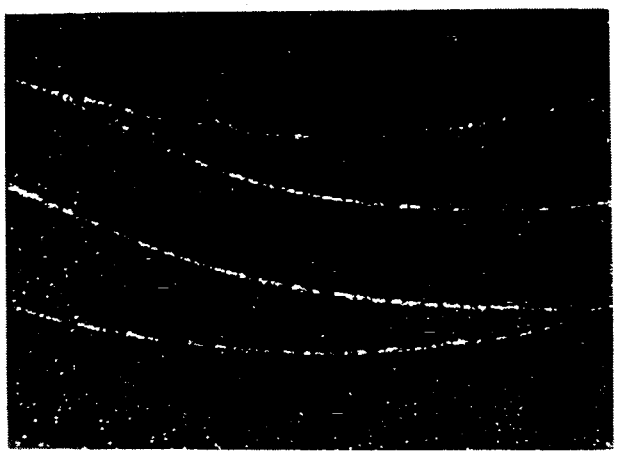
FIG. 5 is a dot map of copper from the same location as FIG. 4.
Figure 6:
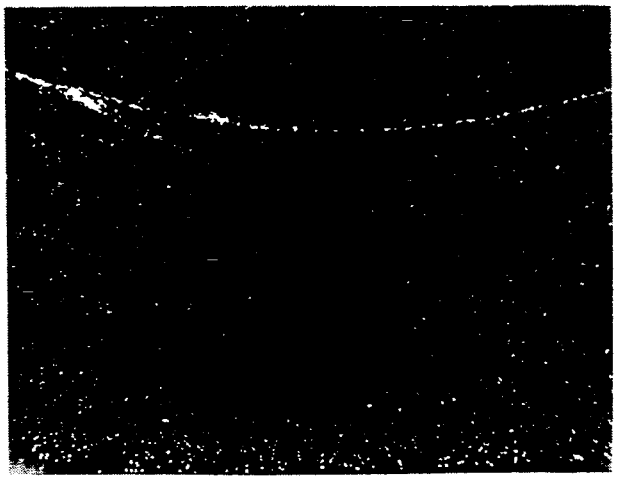
FIG. 6 is a dop map of tin at the same location as FIG. 4.

Also, at the seam section of the cross section of the pipe wall, the 40-times enlarged SEM photograph was as shown in FIG. 4, and the dot map showing the copper and tin powder condition was as shown in FIG. 5 and FIG. 6. Due to the shortness of melting time, the penetration by diffusion of the brittle Sn-Cu alloy layer into the joint of the seam section is minimal, and the high malleability of the copper layer remains so that it was observed that it does not give cause to segregation of the seam section at later processing as bulge and spool.

COMPARATIVE EXAMPLE 1

Using a double walled steel pipe similar to the one used in the Example 1, and the similar tin-zinc alloy coating material, in accordance with the hitherto method, the material was passed through the nitrogen gas atmosphere set furnace having a heating section length of 2.6 m, at a rate of 220/min., and heated to 1000° C., after which it was cooled by passing through the cooling tank connected to the exit of the heating section.

Figure 7:
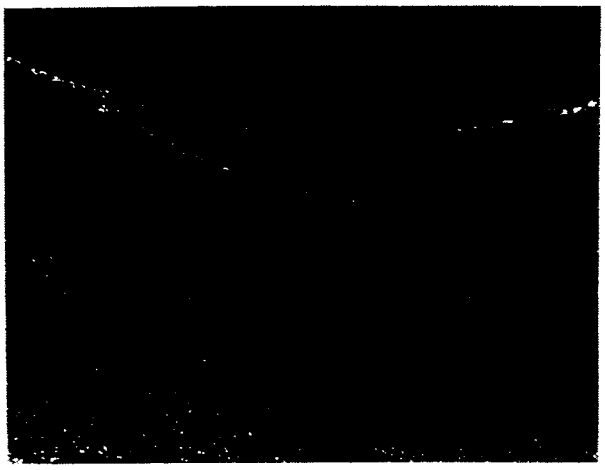
FIG. 7 and FIG. 8 show the coating formation condition taken from the comparative example and correspond respectively to FIG. 6 and FIG. 1.
Figure 8:
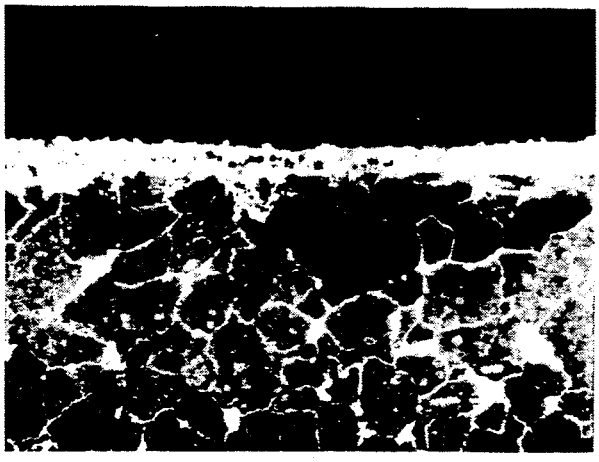
Figure 9:
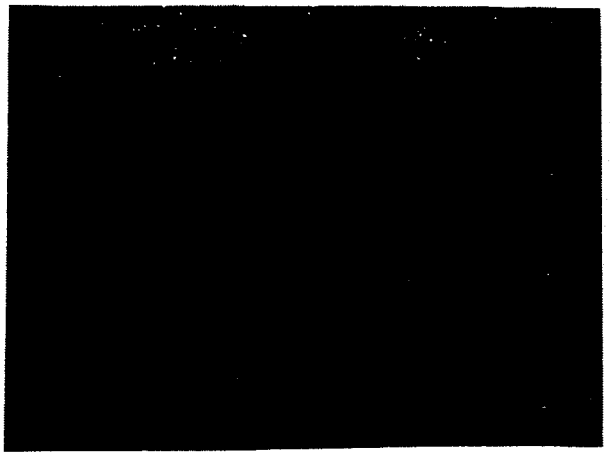
FIG. 9 and FIG. 10, taken from the same location as FIG. 8, show the tin and copper powder condition respectively, and correspond to FIG. 2 and FIG. 3.
Figure 10:
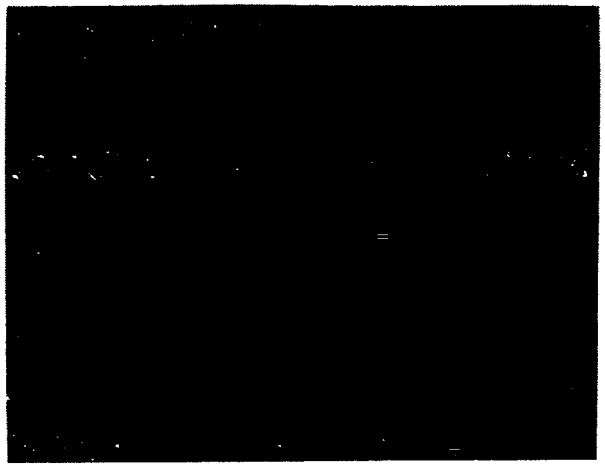
Figure 11:
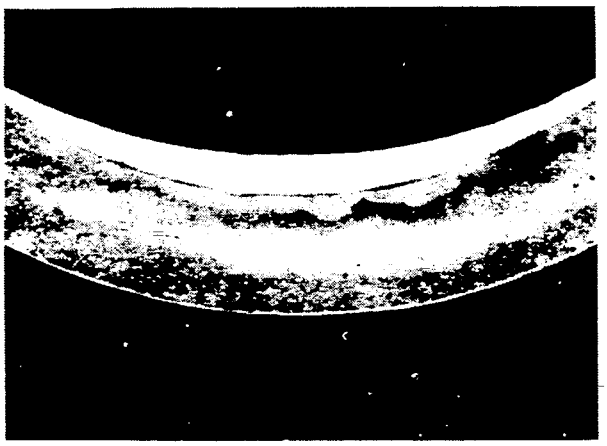
FIG. 11 is the metal structure figure, showing the coating residue in the comparative example enlarged to 25 times by the SEM photograph.
Figure 12:
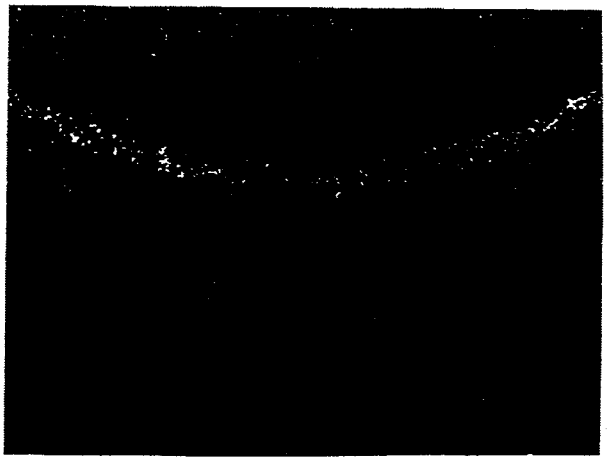
FIG. 12 is a dot map of tin taken from the same angle as FIG. 11.

The same observations were conducted for this product as in the Example 1. That is, the dot map of the seam section is as shown in FIG. 7, and the penetration by diffusion of the tin into the seam section was maximal, and it was found that the danger of segregation was serious even for plastic processing with low processing rate. Also the SEM photograph of the interior wall of the pipe was as shown in FIG. 8, while the tin and copper dot map was as shown in FIG. 9 and FIG. 10. The tin coating layer had hardly been formed and only the copper diffusion layer had formed. Also, through the SEM photograph, shown by FIG. 11, and the dot map of tin, shown in FIG. 12, it was observed that the tin had turned to a residue, lumped at the bottom of the pipe, so that uniform coating had not been formed.

EXAMPLE 2

A diameter 0.5 mm tin wire material was inserted into an electric welded pipe of external diameter 0.8 mm, thickness 0.7 mm, and length 7 m, plated inside with copper plate of thickness 3 μm, and treated as in the Example 1, to form a coating on the interior of the electric walled pipe.

The SEM photograph of the cross section segment, and the tin and copper dot maps of this product were observed by the same method as in the Example 1. As a result, as in Example 1, it was observed that a uniform coating had been formed.

EXAMPLE 3

Using an electric welded pipe similar to that used in Example 2, a tin based, zinc plated wire of diameter 0.5 mm was inserted, treated by the same method as in Example 1, to form a coating in the interior of the walled pipe.

Observations, similar to those conducted in the Example 2, were conducted and it was found that a similarily uniform coating had been formed.

EXAMPLE 4

Using an electric welded pipe similar to that used in Example 1, a tin-zinc clad wire material of diameter 0.5 mm was inserted in it, treated by the same method as in Example 1, to form a coating in the interior of the electric walled pipe.

Observations, similar to those conducted in the Example 2, were conducted, and it was found that a similarly uniform coating had been formed.

COMPARATIVE EXAMPLE 2

Using an electric walled pipe similar to that used in Example 2, a tin-zinc alloy wire material of diameter 0.5 mm was inserted, treated by the same method as in the Comparative Example 1, and observed by the same method as in Example 2.

Figure 13:
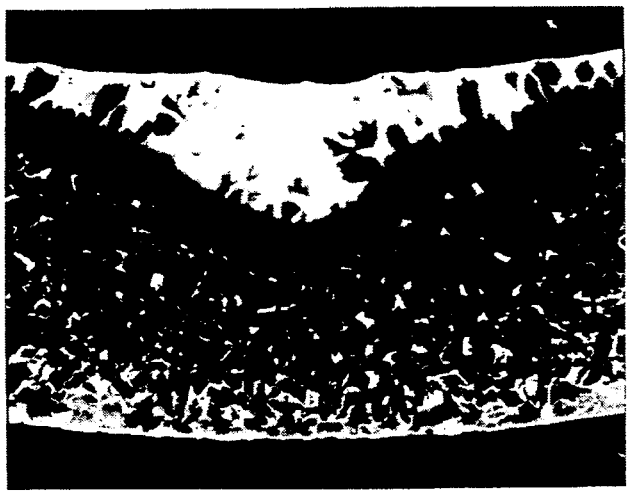
FIG. 13 is a metal structure figure showing the metal corrosion condition of the comparative example, enlarged to 65 times by the SEM photograph.
Figure 14:
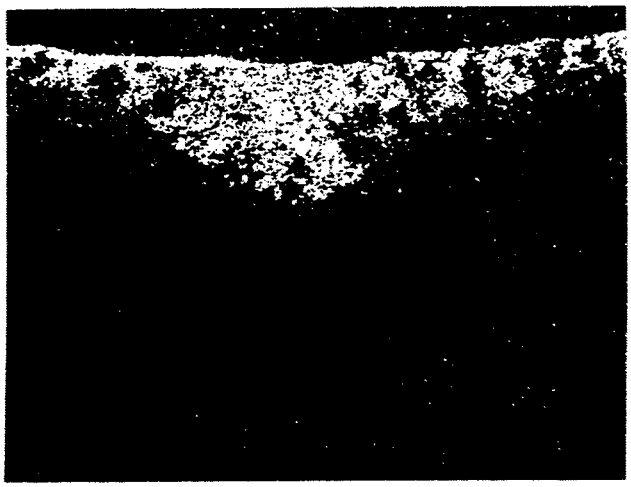
FIG. 14 is a dot map of tin at the same location as FIG. 13.

As a result, the SEM photograph was as shown in FIG. 13, and the dot map of tin as snown in FIG. 14. Metal corrosion was found to be quite deep, and, furthermore, to have been formed intermittently throughout the length of the pipe.

I claim:

1. A method of manufacturing metal pipes internally coated with a uniform coating of coating material, said method comprising the steps of:

providing a metal pipe having a diameter of less than about 20 mm;

inserting a coating material into and along the length of the pipe, the coating material being selected from the group consisting of tin, zinc alloy, tin-lead alloy, zinc-plated tin and zinc clad tin;

passing the pipe and the coating material through a high frequency furnace at a speed of between about 5–50 m/min, said furnace being at a sufficiently high frequency to raise the temperature of the pipe to over 1000° C. for a sufficient time to allow the coating material to form a uniform coating in the pipe without causing an oxidated layer to form on the surface of the uniform coating, said furnace having therein a gas selected from the group consisting of non-active gas; non-oxide atmospheric gas and reducing atmospheric gas; and rapidly cooling the pipe in the same type of gas as the gas in the furnace, said gas being cooled to a temperature of −10° C. during the rapid cooling of the pipe.

2. The method as in claim 1 wherein the said metal pipe comprise double walled metal pipe or electric welded metal pipe.

3. The method as in claim 1 wherein the said coating material is a wire, thin sheets or powder.

4. The method as in claim 1, wherein the metal pipe interior is pre-treated with copper plating.

5. A method as in claim 1 wherein the coating material is initially in the form of a wire, and wherein the step of inserting the coating materials comprises inserting the wire into the pipe.

6. A method as in claim 1 wherein the coating material is initially in the form of a strip, and wherein the step of inserting the coating material comprises inserting the strip into the pipe.

7. A method as in claim 1 wherein the furnace operates at a frequency of 10–400 KHz.

* * * * *